US011393417B2

(12) United States Patent
Bonnet

(10) Patent No.: US 11,393,417 B2
(45) Date of Patent: Jul. 19, 2022

(54) BACKLIGHT SOURCE SELECTION BASED ON POWER SOURCE

(71) Applicant: Hewlett-Packard Development Company, L.P., Spring, TX (US)

(72) Inventor: Alois Bonnet, Houston, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/043,258

(22) PCT Filed: Jul. 19, 2018

(86) PCT No.: PCT/US2018/042817

§ 371 (c)(1),
(2) Date: Sep. 29, 2020

(87) PCT Pub. No.: WO2020/018100

PCT Pub. Date: Jan. 23, 2020

(65) Prior Publication Data

US 2021/0134234 A1 May 6, 2021

(51) Int. Cl.
*G09G 3/34* (2006.01)

(52) U.S. Cl.
CPC ..... *G09G 3/3426* (2013.01); *G09G 2330/021* (2013.01)

(58) Field of Classification Search
CPC ..... G09G 3/3426; G09G 2330/021
See application file for complete search history.

(56) References Cited

U.S. PATENT DOCUMENTS

| | | | | |
|---|---|---|---|---|
| 6,151,008 | A | 11/2000 | Zhang | |
| 6,885,360 | B2 * | 4/2005 | Hara | G09G 3/3406 349/68 |
| 9,538,624 | B2 * | 1/2017 | Zhang | G09G 3/342 |
| 9,558,721 | B2 | 1/2017 | Sakariya et al. | |
| 9,705,042 | B2 | 7/2017 | Bower et al. | |
| 9,911,722 | B2 | 3/2018 | Higginson et al. | |
| 9,922,966 | B2 | 3/2018 | Bibl et al. | |
| 2003/0090454 | A1 * | 5/2003 | Adler | G06F 1/1601 345/102 |
| 2004/0104885 | A1 | 6/2004 | Adler | |
| 2008/0315785 | A1 * | 12/2008 | Price | H05B 41/282 315/277 |
| 2010/0045623 | A1 | 2/2010 | Sakurai | |
| 2012/0169608 | A1 * | 7/2012 | Forutanpour | G06F 1/3265 345/173 |
| 2013/0286271 | A1 * | 10/2013 | Ishii | G09G 3/3607 348/333.01 |
| 2014/0062329 | A1 * | 3/2014 | Zhang | H05B 47/16 315/210 |

(Continued)

FOREIGN PATENT DOCUMENTS

CN 204350349 5/2015

*Primary Examiner* — Towfiq Elahi
(74) *Attorney, Agent, or Firm* — Michael A. Dryja

(57) ABSTRACT

An example apparatus includes a display panel, at least two backlight sources to backlight the display panel, and a controller to selectively activate a first backlight source of the at least two backlight sources when a first power source is detected and to selectively activate a second backlight source of the at least two backlight sources when a second power source is detected, the first backlight source and the second backlight source being different.

7 Claims, 5 Drawing Sheets

(56) References Cited

U.S. PATENT DOCUMENTS

| | | | | |
|---|---|---|---|---|
| 2014/0104885 | A1* | 4/2014 | Zhang | G02B 5/0242 362/625 |
| 2014/0307200 | A1* | 10/2014 | Yamashita | G02F 1/133603 349/61 |
| 2015/0102992 | A1* | 4/2015 | Klement | G06F 1/3228 345/102 |
| 2016/0218257 | A1 | 7/2016 | Ray et al. | |
| 2016/0309555 | A1* | 10/2016 | Kang | H05B 45/44 |
| 2017/0092196 | A1 | 3/2017 | Gupta et al. | |
| 2017/0256212 | A1 | 9/2017 | Dunn et al. | |
| 2018/0102492 | A1 | 4/2018 | Bibl et al. | |

* cited by examiner

BACKLIGHT SOURCE SELECTION BASED ON POWER SOURCE

BACKGROUND

Display monitors are used for a variety of applications, such as monitors for computing systems or televisions. Such display monitors include a display panel which may include, for example, a liquid crystal display (LCD) or a plasma discharge panel (PDP). The displays may be of any of a variety of sizes. The display panel is provided with backlighting, the level of which may determine brightness of the display.

BRIEF DESCRIPTION OF THE DRAWINGS

For a more complete understanding of various examples, reference is now made to the following description taken in connection with the accompanying drawings in which.

DETAILED DESCRIPTION

As noted above, various display devices include a display panel and backlighting. Certain display devices, such as organic light-emitting diode (OLED) display devices, lack any backlighting with the OLED providing its own color. OLED devices have the drawbacks of increased cost, reduced durability, and reduced brightness. In some examples, an array of light-emitting diodes (LEDs) is provided behind the display panel. The LED light may be passed through filters to provide the desired color on the display panel. Backlighting may be provided via an edge backlight source provided on one edge of a display panel. The edge backlight may then be directed from the edge of the display panel through, for example light pipes to provide backlighting for substantially the entire display panel. The edge backlighting provides efficient backlighting with low power consumption. Recent advances have led to the development of micro-LED devices which may include a backlight panel which includes a large number of LEDs (e.g., millions) on a panel. The micro-LED panels can provide a high level of brightness. At the higher levels of brightness, the micro-LED panels can be power-intensive.

Various examples described herein relate to backlighting for display devices. In various examples, a display device is provided with multiple sources of backlighting. In one example, the display device is provided with an edge backlighting source and a micro-LED backlighting source. The micro-LED backlighting source is advantageous for its ability to provide a high level of brightness, while the edge backlighting source provides the advantage of consuming less power. In this regard, various example display devices are provided with a controller to determine the power source for the display device. If the display device is operating in a plugged-in power mode, the controller can activate the micro-LED backlighting source. On the other hand, when the display device is in a battery-powered mode, the controller can activate the edge backlighting source to conserve power. Thus, when sufficient power is available, the display device can take advantage of the high level of brightness provided by the micro-LED backlighting, while providing a longer operating life in the battery-powered mode.

Figure 1:
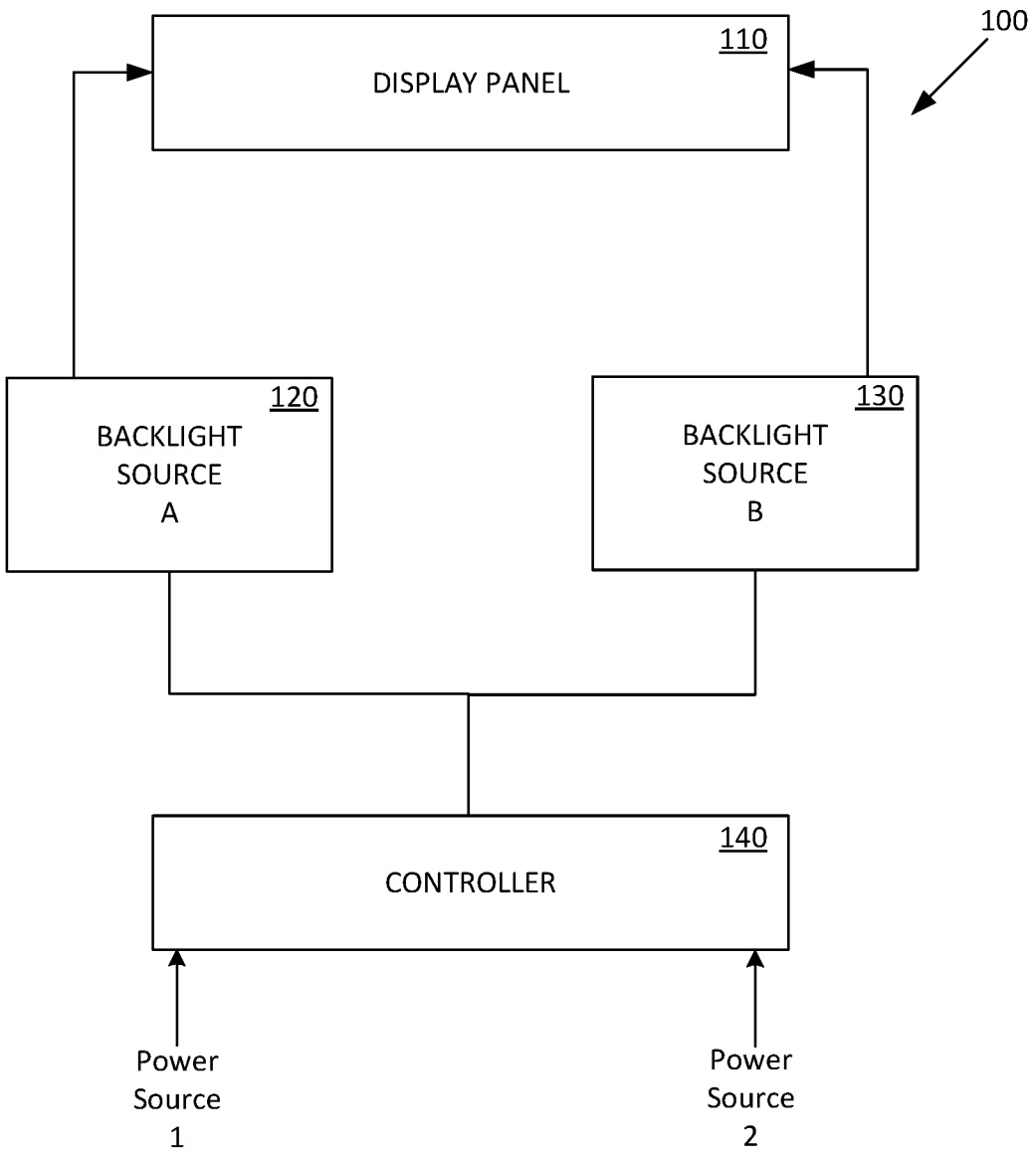
FIG. 1 illustrates an example apparatus for backlight source selection.

Referring now to FIG. 1, an example apparatus 100 for backlight source selection is illustrated. The example apparatus 100 includes a display panel 110. In one example, the display panel 110 includes an LCD display panel. As noted above, the display panel 110 may be of any practical size. The example apparatus 100 further includes at least two backlight sources. In the example illustrated in FIG. 1, the apparatus 100 includes a backlight source A 120 and a backlight source B 130. In one example, as described below with reference to FIG. 2, one backlight source (e.g., backlight source A 120) is an edge backlight source, and another backlight source (e.g., backlight source B 130) is a micro-LED backlight source.

The example apparatus 100 of FIG. 1 further includes a controller 140. The controller 140 may be implemented as hardware, software or firmware and may be provided to control various operations of the example apparatus 100. For example, the controller 140 may be coupled to a video source (not shown in FIG. 1) to receive instructions and data for displaying video images on the display panel 110. In the example apparatus 100 of FIG. 1, the controller 140 is provided to selectively activate one of the backlight sources 120, 130 based on a detected power source. In this regard, the controller 140 may selectively activate one backlight source (e.g., backlight source A 120) when a first power source is detected. The controller 140 may selectively activate a different backlight source (e.g., backlight source B 130) when a second power source is detected. In one example, the controller 140 may selectively activate an edge backlight source when a battery power source is detected, and may selectively activate a micro-LED backlight source when a plug-in power source is detected.

Figure 2:
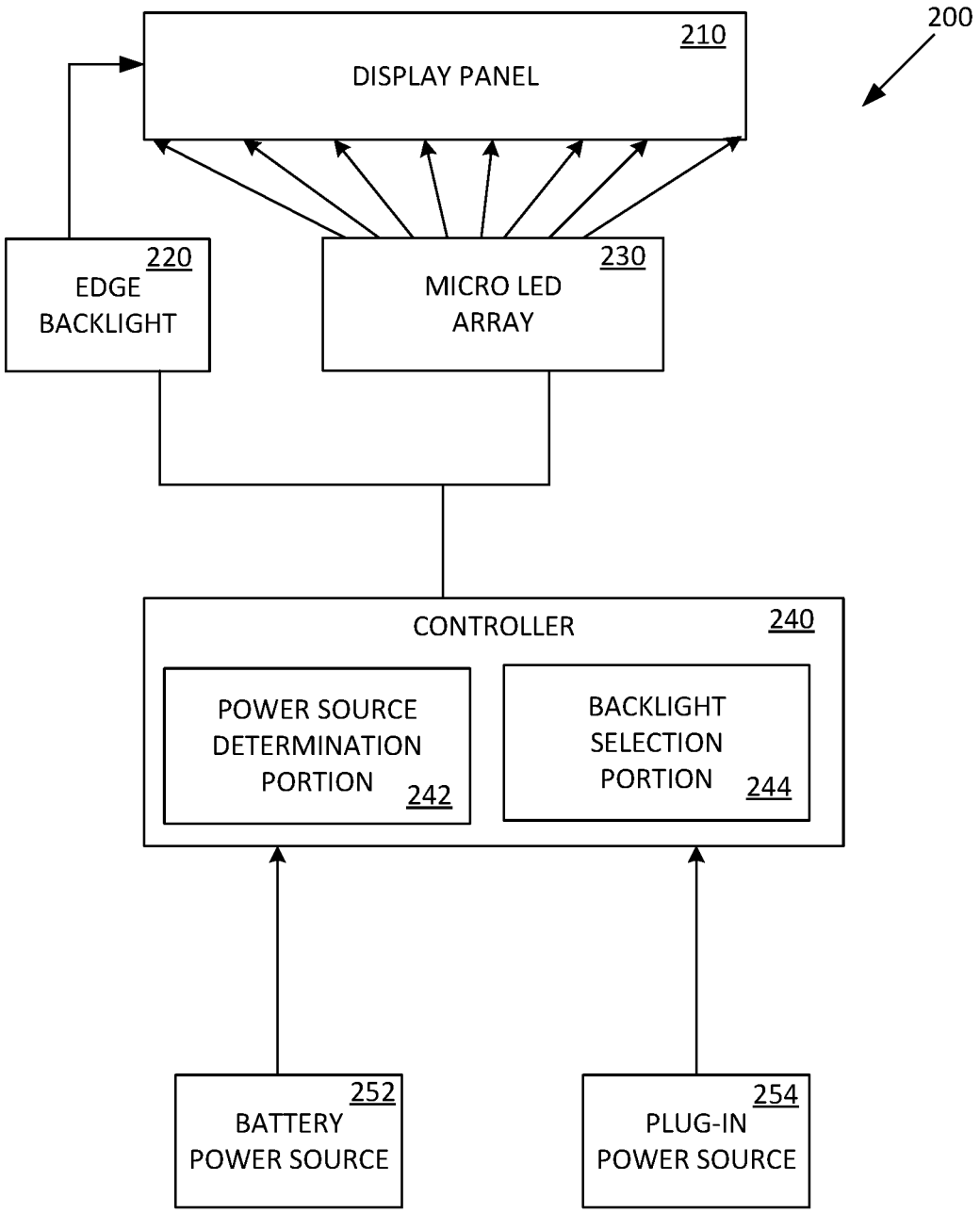
FIG. 2 illustrates another example apparatus for backlight source selection.

Referring now to FIG. 2, another example apparatus for backlight source selection is illustrated. The example apparatus 200 may be a display device such as a monitor coupled to a computing device. The example apparatus 200 includes a display panel 210, such as an LCD panel, for example, which may be of any practical size.

Similar to the example apparatus 100 described above with reference to FIG. 1, the example apparatus 200 of FIG. 2 is provided with two backlight sources 220, 230. The first backlight source of the example apparatus 200 is an edge backlight 220, and the second backlight source is a micro-LED array 230. As described above, the edge backlight 220 may be provided to supply light from one edge of the display panel 210. The backlight may then be directed throughout the display panel 210 by, for example, light pipes.

The micro-LED array 230 may include a number of micro-LEDs that correspond to the resolution of the display panel 210. In this regard, in various examples, each micro-LED in the micro-LED array 230 may correspond to a particular pixel on the display panel 210. As noted above, micro-LED backlighting provides improved brightness.

The example apparatus 200 of FIG. 2 includes a controller 240 which may control various aspects of operation of the example apparatus 200. For example, the controller 240 may control content displayed on the display panel 210, as well as communication with a video source, for example.

In the example illustrated in FIG. 2, the controller 240 includes a power source determination portion 242 and a backlight selection portion 244. The power source determination portion 242 is provided to detect which power source is currently providing power to the example apparatus 200. In this regard, the example apparatus 200 may operate in a battery-powered mode in which the power source is a battery power source 252 or operate in a plug-in mode in which the power source is a plug-in power source 254. In various examples, the battery power source 252 may be a battery that is part of, or internal to, the example apparatus 200. In other examples, the battery power source 252 may be an external battery that may be removable from the example apparatus 200. The plug-in power source 254 may be an alternating current power source, such as a wall outlet coupled to an electric grid, for example.

Based on detection of a current power source by the power source determination portion 242, the backlight selection portion 244 may activate one of the backlight sources 220, 230. For example, upon detection that the current power source is the battery power source 252, the backlight selection portion 244 may activate the edge backlight 220. In this regard, the micro-LED array 230 may be de-activated as a backlight source to conserve power. On the other hand, upon detection that the current power source is the plug-in power source 254, the backlight selection portion 244 may activate the micro-LED array 230 as the backlight source. In this regard, the edge backlight 220 may be de-activated as a backlight source.

Figure 3:
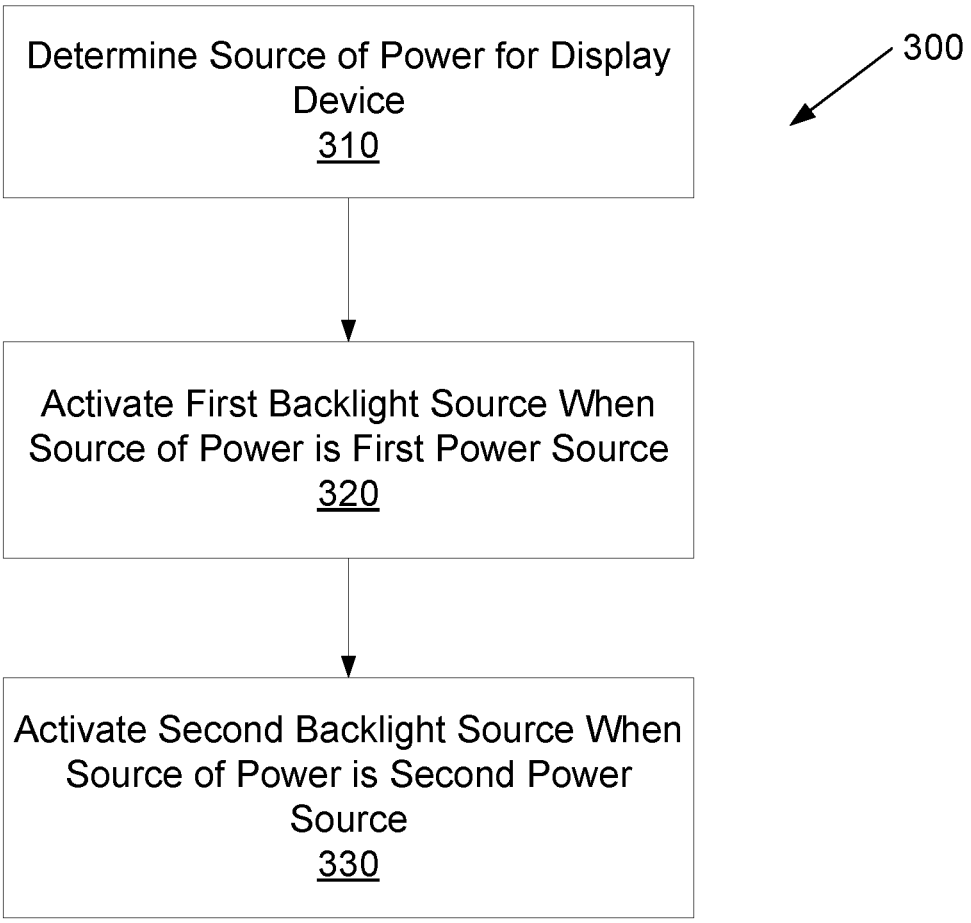
FIG. 3 is a flow chart illustrating an example method for backlight source selection.

Referring now to FIG. 3, a flow chart illustrating an example method 300 for backlight source selection is illustrated. The example method 300 may be implemented in, for example the controller 140, 240 of the example apparatuses 100, 200 described above with reference to FIGS. 1 and 2. The example method 300 includes determining a source of power for a display device (block 310). As described above with reference to FIG. 2, a display device, such as the example apparatus 200, includes a display panel 210 and at least two backlight sources 220, 230 to backlight the display panel 210. The display device may be capable of operating in a first mode in which it is powered by a first power source and in a second mode in which it is powered by a second power source. For example, the display device may operate in a battery-powered mode in which the power source is a battery or in a plug-in mode in which the power source is a plug-in power source. Thus, at block 310, the example method 300 may include determination of whether the display device is powered by a battery or by a plug-in power source.

The example method 300 further includes activating a first backlight source of the at least two backlight sources when the source of power is determined to be a first power source (block 320). For example, as described above, when the power source is determined to be a battery power source, the first backlight source (e.g., the edge backlight source) may be activated. In various example, other backlight sources (e.g., the micro-LED array) may be de-activated.

The example method 300 further includes activating a second backlight source of the at least two backlight sources when the source of power is determined to be a second power source (block 330). For example, as described above, when the power source is determined to be a plug-in power source, the second backlight source (e.g., the micro-LED array) may be activated. In various example, other backlight sources (e.g., the edge backlight) may be de-activated.

In one example, a user may override the selection of the backlight source by the controller. For example, if the display device is in a battery-powered mode, the user may manually select the micro-LED array as the backlight source, electing greater brightness even if the battery life is decreased.

Figure 4:
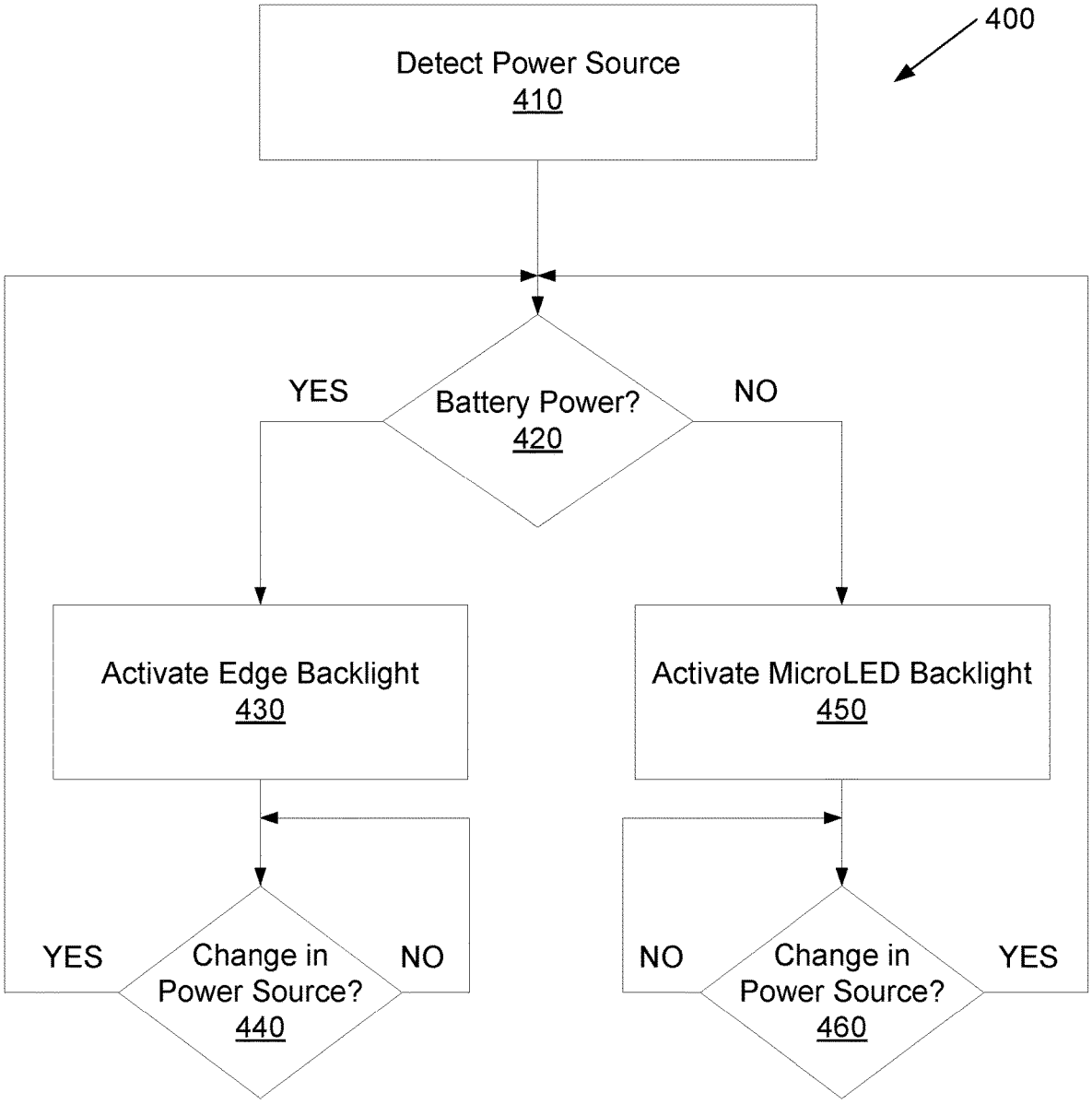
FIG. 4 is a flow chart illustrating another example method for a backlight source selection.

Referring now to FIG. 4, a flow chart illustrating another example method 400 for a backlight source selection is illustrated. The example method 400 may be implemented in, for example the controller 140, 240 of the example apparatuses 100, 200 described above with reference to FIGS. 1 and 2. The example method 400 includes detecting a source of power for a display device (block 410). As described above, a display device, such as the example apparatus 200, includes a display panel 210 and at least two backlight sources 220, 230. The display device may be capable of operating in either a plug-in power mode or a battery power mode. Thus, at block 410, the example method 400 may detect which power source is currently supplying power to the display device. At block 420, a determination is made as to whether or not the power source is a battery power source.

If the power source is determined to be battery power, the example method 400 proceeds to block 430, and the edge backlight is activated. As noted above, the edge backlight consumes less power and allows the display device to operate for a longer period under battery power.

At block 440, the example method 400 determines whether a change in the power source has occurred. If no change in the power source has occurred, the display device continues operating with the edge backlight and continues to monitor for changes in the power source. If a change in power source is detected, the example method 400 returns to block 420.

If, at block 420, the power source is determined to not be battery power, the example method 400 proceeds to block 450, and the micro-LED array is activated as a backlight source. As noted above, the micro-LED array provides improved brightness and may provide additional benefits, such as responsiveness.

At block 460, the example method 400 determines whether a change in the power source has occurred. If no change in the power source has occurred, the display device continues operating with the micro-LED array as the backlight source and continues to monitor for changes in the power source. If a change in power source is detected, the example method 400 returns to block 420.

Figure 5:
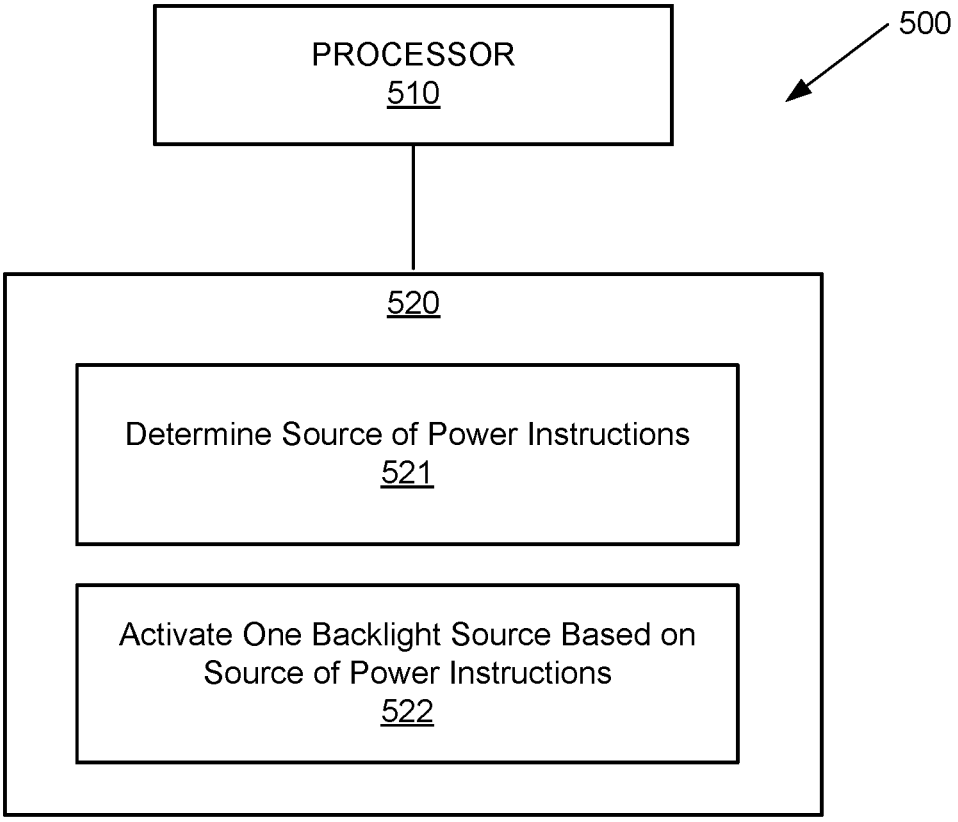
FIG. 5 illustrates a block diagram of an example system with a computer-readable storage medium including instructions executable by a processor for backlight source selection.

Referring now to FIG. 5, a block diagram of an example system 500 is illustrated with a computer-readable storage medium including instructions executable by a processor for backlight source selection. The system 500 includes a processor 510 and a non-transitory computer-readable storage medium 520. The computer-readable storage medium 520 includes example instructions 521-522 executable by the processor 510 to perform various functionalities described herein. In various examples, the non-transitory computer-readable storage medium 520 may be any of a variety of storage devices including, but not limited to, a random access memory (RAM) a dynamic RAM (DRAM), static RAM (SRAM), flash memory, read-only memory (ROM), programmable ROM (PROM), electrically erasable PROM (EEPROM), or the like. In various examples, the processor 510 may be a general purpose processor, special purpose logic, or the like. In various examples, the processor 510 may include or be included in the controller 140, 240 of the example apparatuses 100, 200 described above with reference to FIGS. 1 and 2.

The example instructions include determine source of power instructions 721. As described above with reference to FIG. 2, a display device, such as the example apparatus 200, includes a display panel 210 and at least two backlight sources 220, 230 to backlight the display panel 210. The display device may be capable of operating in a first mode in which it is powered by a first power source (e.g., a battery power source) and in a second mode in which it is powered by a second power source (e.g., a plug-in power source). In this regard, the instructions 721 may determine whether the current source of power is a battery power source or a plug-in power source.

The example instructions further include activate one backlight source based on the source of power instructions 722. As described above with reference to FIG. 3, a first backlight source (e.g., edge backlight) may be activated when the source of power is determined to be a first power source (e.g., battery power source). On the other hand, a second backlight source (e.g., micro-LED array) may be activated when the source of power is determined to be a second power source (e.g., plug-in power source). In each case, other backlight sources may be deactivated.

Thus, in various examples, when sufficient power is available (e.g., via a plug-in power source), the display device can take advantage of the high level of brightness provided by the micro-LED backlighting. When the power source is limited, as may be the case with a battery power source, a longer operating life can be achieved by activating edge backlighting.

Software implementations of various examples can be accomplished with standard programming techniques with rule-based logic and other logic to accomplish various database searching steps or processes, correlation steps or processes, comparison steps or processes and decision steps or processes.

The foregoing description of various examples has been presented for purposes of illustration and description. The foregoing description is not intended to be exhaustive or limiting to the examples disclosed, and modifications and variations are possible in light of the above teachings or may be acquired from practice of various examples. The examples discussed herein were chosen and described in order to explain the principles and the nature of various examples of the present disclosure and its practical application to enable one skilled in the art to utilize the present disclosure in various examples and with various modifications as are suited to the particular use contemplated. The features of the examples described herein may be combined in all possible combinations of methods, apparatus, modules, systems, and computer program products.

It is also noted herein that while the above describes examples, these descriptions should not be viewed in a limiting sense. Rather, there are several variations and modifications which may be made without departing from the scope as defined in the appended claims.

What is claimed is:

1. An apparatus comprising:

a display panel;

at least two backlight sources to backlight the display panel; and a controller to selectively activate just a first backlight source of the at least two backlight sources when a first power source is detected and to selectively activate just a second backlight source of the at least two backlight sources when a second power source is detected, the first backlight source and the second backlight source being different, such that the first backlight source and not the second backlight source is activatable when the first power source is detected and the second backlight source and not the first backlight source is activatable when the second power source is detected, wherein the first backlight source is an edge backlight and the second backlight source is a micro light-emitting diode array, wherein the first power source is a battery power source and the second power source is a plug-in power source, and wherein the controller is to activate the edge backlight when the battery power source is detected and is to activate the micro light-emitting diode array when the plug-in power source is detected.

2. The apparatus of claim 1, wherein the controller is to:

determine whether the source of power is the first power source or the second power source; and selectively activate one of the first backlight source or the second backlight source based on a determination result.

3. The apparatus of claim 1, wherein the battery power source includes a battery internal to the apparatus.

4. A method comprising:

determining a source of power for a display device, the display device including a display panel and at least two backlight sources to backlight the display panel;

activating just a first backlight source of the at least two backlight sources when the source of power is determined to be a first power source; and activating just a second backlight source of the at least two backlight sources when the source of power is determined to be a second power source, wherein the first backlight source and not the second backlight source is activatable when the first power source is detected and the second backlight source and not the first backlight source is activatable when the second power source is detected, wherein the first backlight source is an edge backlight and the second backlight source is a micro light-emitting diode array, wherein the first power source is a battery power source and the second power source is a plug-in power source, and wherein the edge backlight is activated when the battery power source is detected and the micro light-emitting diode array is activated when the plug-in power source is detected.

5. The method of claim 4, wherein the battery power source includes a battery internal to the apparatus.

6. A non-transitory computer-readable storage medium encoded with instructions executable by a processor of a computing system, the computer-readable storage medium comprising instructions to:

determine a source of power for a display device, the display device including a display panel and at least two backlight sources, including a first backlight source and a second backlight source, to backlight the display panel;

activate just one backlight source of the at least two backlight sources based on the determined source of power, wherein the first backlight source and not the second backlight source is activatable when the first power source is detected and the second backlight source and not the first backlight source is activatable when the second power source is detected, wherein the first backlight source is an edge backlight and the second backlight source is a micro light-emitting diode array, wherein the first power source is a battery power source and the second power source is a plug-in power source, and wherein the edge backlight is activated when the battery power source is detected and the micro light-emitting diode array is activated when the plug-in power source is detected.

7. The non-transitory computer-readable storage medium of claim 6, wherein the battery power source includes a battery internal to the display device.

* * * * *